United States Patent [19]

Leloux

[11] Patent Number: 4,517,868

[45] Date of Patent: May 21, 1985

[54] METHOD OF AND DEVICE FOR MAKING PERFORATIONS IN A TUBULAR WEB OF PLASTICS FOIL

[75] Inventor: Arnoldus W. J. Leloux, Dedemsvaart, Netherlands

[73] Assignee: Wavin B.V., Netherlands

[21] Appl. No.: 500,422

[22] Filed: Jun. 2, 1983

[30] Foreign Application Priority Data

Jun. 2, 1982 [NL] Netherlands ..... 8202231

[51] Int. Cl.[3] ..... B31B 31/14; B26F 1/06

[52] U.S. Cl. ..... 83/54; 83/178; 83/191; 493/238

[58] Field of Search ..... 83/54, 178, 183, 184, 83/188, 191; 493/237, 238, 227, 363, 364, 372

[56] References Cited

U.S. PATENT DOCUMENTS

| | | | |
|---|---|---|---|
| 1,048,348 | 12/1912 | Rowley | 83/178 |
| 1,588,200 | 6/1926 | Skelton | 83/178 |
| 2,923,194 | 2/1960 | Ambler et al. | 83/180 X |
| 3,259,003 | 7/1966 | Griffin | 83/54 |
| 3,288,006 | 11/1966 | Erlandson | 83/183 X |
| 3,487,668 | 1/1970 | Fuchs | 83/54 X |
| 3,995,518 | 12/1976 | Spiroff | 83/54 |

*Primary Examiner*—Donald R. Schran
*Attorney, Agent, or Firm*—Wigman & Cohen

[57] ABSTRACT

Method of and device for making perforations in the inner gusset portions of a tubular web of plastics foil which is provided with side gussets. Such perforations serve to remove air from the interior of bags to be manufactured from the tubular web. According to the invention the gussets are opened over a distance sufficient to introduce, in the interior thereof, a punching member, which is activated by exerting a pressure from outside the tubular web. A device adapted to perform this method comprises a separate carrier provided at either one of its ends with rolls and adapted to be introduced into the interior of the tubular web where it is supported and maintained in its place lengthwise of the web, by two sets of rolls which are situated at the exterior of the tubular web. The carrier is provided with perforating units and the machine frame outside the tubular foil is provided with means to exert through the web material, a force and to activate the perforating units. Preferably elements for opening the tubular foil comprise sets of conical discs which are rotatable about spindles, such that one each in every set of rolls is situated in each of the two gusset halves.

10 Claims, 4 Drawing Figures

METHOD OF AND DEVICE FOR MAKING PERFORATIONS IN A TUBULAR WEB OF PLASTICS FOIL

BACKGROUND OF THE INVENTION

The invention relates to a method of and a device for making perforations in the inner gusset portions of a tubular web of plastics foil which is provided with side gussets.

This constitutes a new aim in the treatment of tubular foil, particularly in view of manufacturing bags. Perforations in the inner gusset portions would be able to serve to remove air from such bags, when filled. They may be provided such that nevertheless it is impossible for liquids, such as for example dew water, as is often formed on the bags in storage, to penetrate.

SUMMARY OF THE INVENTION

The invention proposes a method of making such perforations wherein the gussets are opened over a distance sufficient to introduce, in the interior of the gusset, a punching member, said punching member being activated by exerting a pressure from the exterior of the tubular web.

Preferably this is realized such that in each gusset the two gusset halves are opened simultaneously, in that a punching member is introduced into the two halves, and that, by exerting the pressure from the exterior, the inner gusset portions of each gusset are both perforated.

The method proposed according to the invention can be realized with a device which comprises: a separate carrier having rolls at either one of its ends and being adapted to be introduced into the interior of the tubular web where it is supported and maintained in its place, lengthwise of the web, by two sets of rolls which are carried by the machine frame and are situated at the exterior of the tubular web. The carrier is carrying perforating units which are so dimensioned and so arranged that they are situated in the gussets. The machine frame outside the tubular foil is provided with means to exert a force through the web material and to activate the perforating units.

Within the framework thus depicted, numerous solutions are possible, though, for embodying the perforating units, arranging counter pressure members and for the choice of the location where one intends to make the perforation. Particularly it is a matter of choice whether this is done in one of the inner gusset portions only, or simultaneously in both inner gusset portions. All this will become apparent after reading the further description.

The invention will now be clarified with reference to the accompanying drawing of an embodiment.

DESCRIPTION OF THE DRAWINGS

FIG. 3 is a partial horizontal section according to the arrows III—III of FIG. 1

DESCRIPTION OF THE PREFERRED EMBODIMENTS

Figure 1:
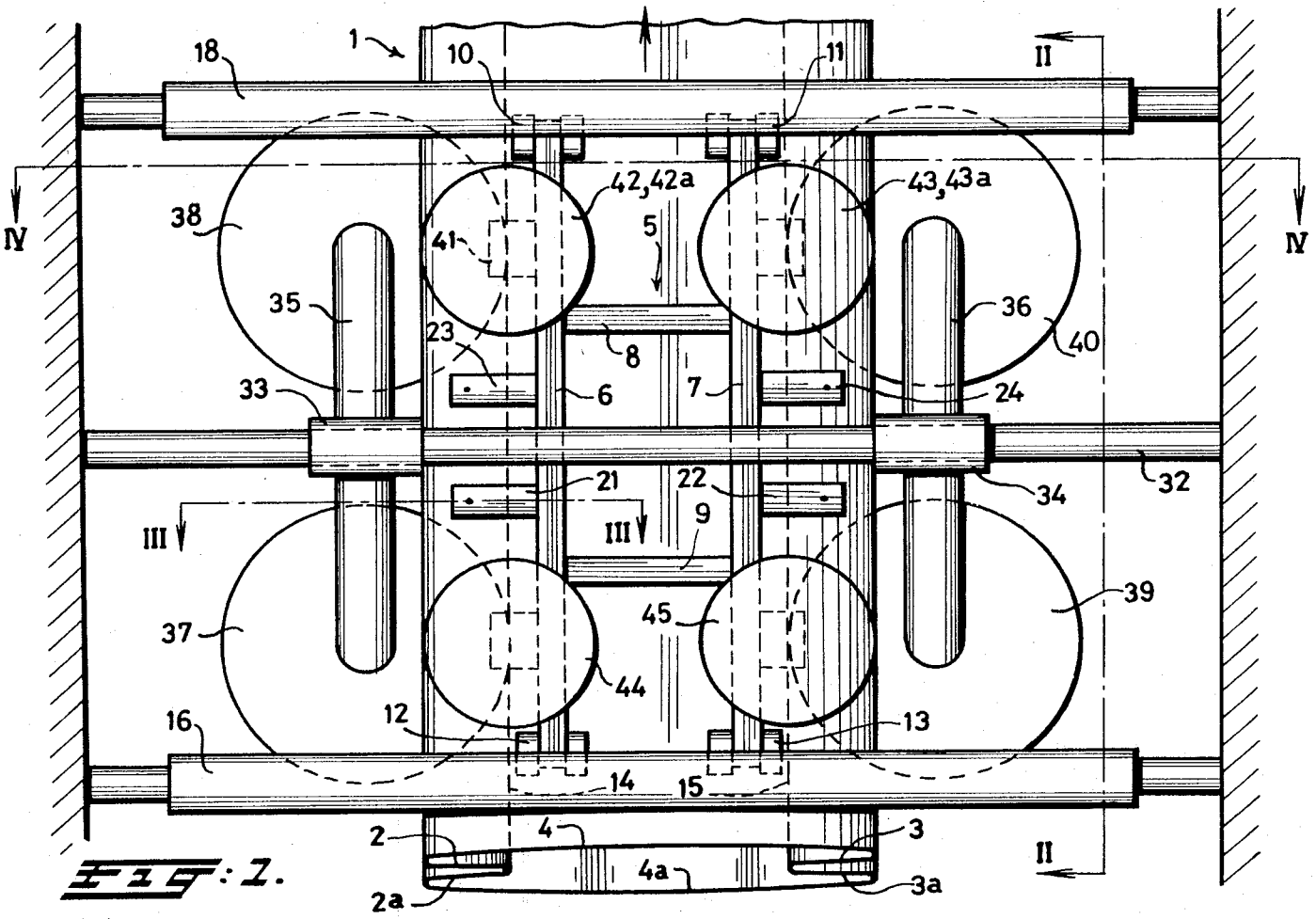
FIG. 1 diagrammatically shows an elevational view of the device.

In FIG. 1, apart from the device, there is also diagrammatically represented the tubular web of foil 1, of the type which is envisaged by the invention. At the bottom of this figure it is visible that on either side of the tube side gussets are present, consisting of inner side gusset portions 2, 2*a* at one side and inner side gusset portions, 3, 3*a* at the other side, these side gusset portions being situated between outer layers of foil 4, 4*a*.

The aim of the invention is to make perforations in the inner side gusset portions 2, 2*a*,-3, and 3*a*. To this end a carrier, indicated in its entirety by 5, is introduced into the interior of the tube 1. The carrier 5 may consist of two longitudinal elements 6 and 7 which are kept apart by cross pieces 8 and 9.

On either end of each of the two cross pieces 6 and 7 rolls, indicated by 10, 11, 12, 13, are provided. Each of these rolls, in the embodiment represented, is a double roll. The axes of a rotation thereof are situated substantially in the plane of carrier 5 in front of the beams 6–9 and the axes of rotation extend parallel to the cross beams 8 and 9.

The carrier 5 is dimensioned such that the pair of rolls 10, 11 and 12, 13, respectively, stay within the side gussets, i.e. that the total width thereof is less than the mutual distance of the inner gusset edges 14, 15, respectively. For the rest, when it is desired to use the device for several multiple values of the width of the tubular foil 1, the width of the carrier may simply be made adaptable, for example by changing the length of the cross pieces 8, 9 by a telescoping connection or by means of slits.

Figure 2:
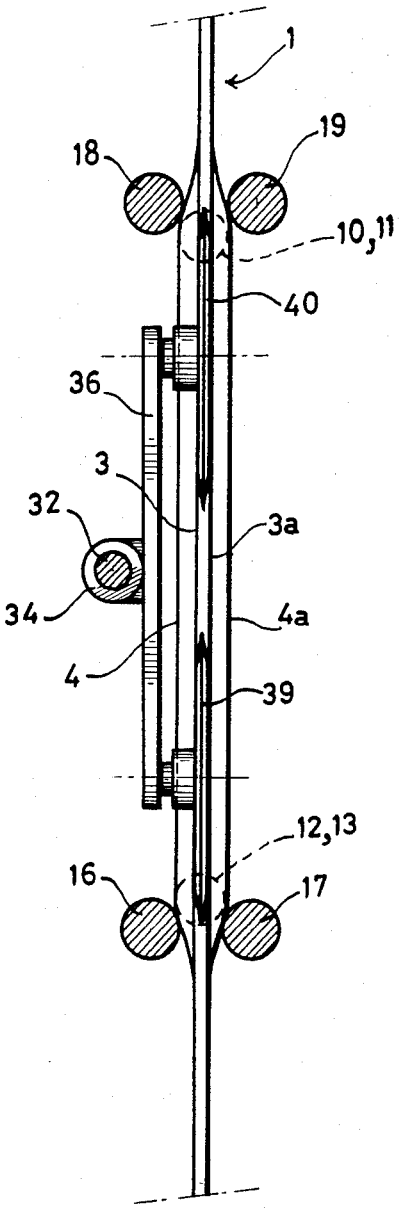
FIG. 2 is a side view according to the arrows II—II of FIG. 1.

The carrier described is introduced into the interior of the tube when the beginning extreme end of a tube 1, as produced, is passed through the machine. It is done by guiding the tube material over the carrier. Then the carrier 5 is kept in place lengthwise of the tubular foil 1—corresponding to the sense in which the tubular foil passes through the machine and indicated by the arrow P—by a pair of lower rolls 16, 17 (see also FIG. 2) and a pair of similar upper rolls 18, 19. The mutual distance of each set of rolls such as 16, 17 is less than the diameter of rolls 12, 13 provided on the carrier 5. As will be understood from FIG. 2 the distance between the sets of exterior rolls 16, 17 and 18, 19 respectively, lengthwise of the tubular foil 1, just exceeds the distance in the same direction between the set of rolls 10, 11 on the one hand and 12, 13 on the other hand, so that the whole carrier 5 is stably kept in its place.

The rolls 16–19 are rotatably bearing in the machine frame, which is indicated by 20.

The carrier 5 serves to carry punching elements or perforating elements. As appears from FIG. 1 four such perforating units are provided, indicated by 21, 22, 23, 24. Because the structure of all of these units is identical, only unit 21 will be described with reference to FIG. 3. The perforating units project in lateral direction with respect to the longitudinal elements 6, 7 of the carrier. The unit comprises a fixed supporting arm 25 and a movable arm 26. These two arms are each situated substantially on one side of the longitudinal central plane through the carrier, such that each may come to lie in one side gusset half, with the inner side gusset portions which are to be perforated, such as 2, 2*a*, lying between the arms 25, 26, as will be further clarified yet. The movable arm 26 carries a punch 27. In fixed arm 25 a rubber base plate 28 is provided. The movable arm 26 is urged away from the fixed arm 25 by a spring which, however, has not been drawn.

Outside the tubular foil an air cylinder 29 is affixed to the machine frame (the fixation has not been represented in FIG. 3). On the end of the piston rod 30 thereof a rubber cap 31 is affixed, which is arranged opposite the movable arm 26. So by operation of the cylinder 29 the cap 31 can simply press against the outer foil layer and thereby exert an impact force on the movable arm 26 by which, by means of punch 27, the desired perforations will be made in the inner side gusset portions such as 2, 2*a*.

In order to secure that the side gussets will always open sufficiently and in the correct manner to admit the punching device, according to the invention preferably also the following measures are applied.

On the machine frame 20, substantially midway between the sets of rolls 16, 17 and 18, 19, a shaft 32 is provided. Two guide members 33 and 34, respectively, are movable past it. These are supporting vertical beams 35 and 36, respectively, which at their ends carry discs 37, 38, 39 40. These discs are rotatable with respect to the beams.

As appears from FIG. 3 these discs such as 34 are situated substantially in the longitudinal central plane of the device as operable and they are arranged such that they may arrive between the inner side gusset portions 2, 2*a* to be perforated. To this end the guide members such as 33 are preferably under the action of an inwardly directed spring force (springs have not been drawn) so that the discs such as 37 will be urged, by this spring force, against the inner side gusset edge such as 14. By this action on either side the tubular foil and the whole apparatus are kept in place laterally.

Figures 4, 5:
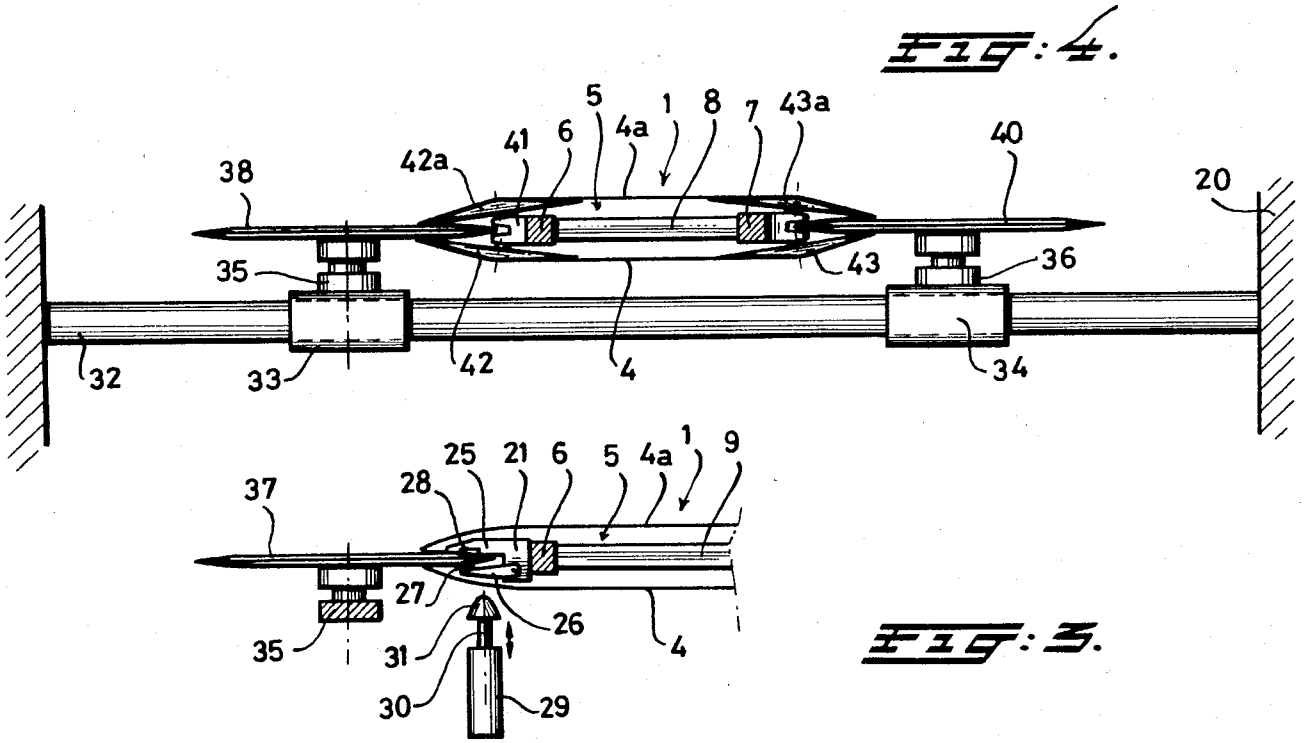
FIG. 4 is a horizontal section according to the arrows IV—IV of FIG. 1.

As appears from FIG. 1 the discs such as 37 are not situated at the level of the perforating units such as 21, but at a certain distance from these. Each disc such as 37 cooperates with two smaller discs, also rotatable, having the axis of rotation at the same height, but which are provided on the carrier 5 and are therefore situated in the interior of the tubular foil. The correct internal arrangement appears best from FIG. 4. On a longitudinal carrier beam such as 6 a small block 41 is affixed, carrying the axes of rotation for the set of discs 42, 42*a*. Each of these discs is a cone having a great apex angle, the axes of rotation of the discs having a corresponding angle with respect to the central longitudinal plane of the device. In this way a condition is reached which is represented in FIG. 4, in which the discs such as 42, 42*a* keep the outer tube foil layers 4, 4*a* in a mutually parallel position on the one hand, and being inserted into each half side gusset on the other hand in order to keep it tight on either side of the disc situated exteriorly (38 in FIG. 4). Together with similar discs 43, 43*a* on the other side of the carrier, on top, they secure that the tubular foil is opened and kept tight in appropriate manner. Near the bottom of the carrier 5 sets of discs realized entirely in the same manner, and indicated by 44 and 45 respectively, are provided in order to maintain the open condition of the tubular foil over a sufficiently great length so as to be able to perforate properly.

For the rest it is advantageous to utilise the beams 35, 36, which carry the exterior discs, as means to affix the air cylinders such as 29. Each air cylinder then has, in lateral direction, a fixed position with respect to the exterior disc such as 37. Because, as stated, this disc urges against the inner side gusset edge, the air cylinder will also arrive at a fixed distance with respect to said inner side gusset edge, and thereby it comes within the reach of the movable arm 26 of the punching device.

In the above a preferred embodiment of the method and the device, respectively, according to the invention, has been described. A number of other solutions is also feasible, however. In the basic idea of the invention the important thing is that the side gussets are opened over a distance which is sufficient for introducing some punching element into the interior thereof, said punching element subsequently being activated by exerting a force from the outside, so through the foil material. It is not necessary, as with the embodiment described, to perforate the two inner side gusset portions such as 2, 2*a;* it is feasible also that perforations in only one of these side gusset portions will do. In that case the perforating unit can be realized differently, for example maintaining the idea of the movable arm with the punch such as 26, but with the disc such as 37 functioning as counter pressure element. This disc might possibly be replaced by a non-rotating element. On the other hand it is also feasible to have the punching element, which is introduced into the interior of the tube, comprise a counter pressure element, the punching then being done from the space situated exteriorly from the tubular foil, but between the inner side gusset portions such as 2, 2*a,* so from the location where the discs such as 37 or 38 are situated. In that case the side gussets will be opened in a somewhat different manner, but also for this, in that case, solutions will lie at hand which can simply be derived from the design and arrangement respectively, of the conical discs such as 42, 42*a* etc.

In any case the device as a whole may be mounted on an apparatus for manufacturing a web of bags on a roll, starting from a roll of tubular foil provided with side gussets, always as known in itself.

As a matter of course the foil web should stand still for a short moment in order to be able to make the perforations. The most simple solution is that perforating is done during the time intervals in which the foil web is at standstill anyhow for making seals. The perforating station may then be arranged before the sealing station, at a distance which will depend on the unit length of the bags to be manufactured.

When applying the four perforating units 21–24 as described, it was assumed that it is desirable to make perforations in all corners of a bag, there furthermore being supposed that seals and tearing perforations are made between the perforating units 21, 22 on the one hand and 23, 24 on the other. For other applications or embodiments the arrangement of the perforating units with respect to the carrier may, as a matter of course, be simply adapted to the requirements, with corresponding modifications in the arrangement of the various discs serving to do the opening.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A method of making perforations in the inner gusset portions of a tubular web of plastics foil which is provided with side gussets having gusset halves comprising the steps of:

opening the gussets over a distance sufficient to introduce, into the interior thereof, a punching member;

inserting a punching member into the interior thereof; and exerting a pressure from the exterior of the tubular web, so as to activate said punching member.

2. A method according to claim 1, wherein the step of opening comprises opening the gusset halves simultaneously, and introducing a punching member into the halves, and exerting the pressure from the exterior onto said punching member to such an extent that the inner gusset portions of each gusset are both perforated.

3. A device having a frame for making perforations in the inner gusset portions of a tubular web of plastics foil which is provided with side gussets, comprising:

a separate carrier provided at either one of its ends with rolls;

two sets of rolls which are carried by the frame and situated in relation to said rolls provided on said carrier such that they are capable of supporting and maintaining said carrier in its place lengthwise of the web, when, during operation, said carrier has been introduced into the interior of the tubular web with said rolls carried by the frame being situated at the exterior of the tubular web;

the carrier being further provided with perforating units which are so dimensioned and so arranged that when during operation said carrier is inside the tubular web, said perforating units are situated in the gussets;

the frame outside the tubular foil being provided with means for exerting through the web material a force to activate the perforating units.

4. A device as claimed in claim 3, wherein the carrier is provided with separate elements for opening the tubular foil.

5. A device as claimed in claim 3, wherein the carrier is provided with separate elements for opening the tubular foil, said separate elements comprising sets of conical discs which are rotatable about spindles arranged under an angle which is equal to half the apex angle of the cone, relative to the central longitudinal plane of the carrier, such that one each in every set of rolls is situated in each of the two gusset halves.

6. A device as claimed in claim 3, wherein the carrier is provided with separate elements for opening the tubular foil, said separate elements being provided at a certain distance upstream and downstream, lengthwise of the foil web, with respect to the perforating units.

7. A device as claimed in claim 3, wherein the carrier is provided with separate elements for opening the tubular foil, said separate elements comprising sets of conical discs which are rotatable about spindles arranged under an angle which is equal to half the apex angle of the cone, relative to the central longitudinal plane of the carrier, such that one each in every set of rolls is situated in each of the two gusset halves, there being an exterior rotatable disc cooperating with each set of opening rolls in the interior and which is movable under spring action relative to the machine frame and is thus urged against the inner gusset edge.

8. A device having a frame for making perforations in the inner gusset portions of a tubular web of plastics foil which is provided with side gussets, the device comprising:

two sets of rolls carried by the frame and situated at the exterior of the tubular web;

a separate carrier provided at either one of its ends with rolls and adapted to be introduced into the interior of the tubular web where it is supported and maintained in its place lengthwise of the web by the two sets of rolls which are carried by the machine frame;

the carrier being provided with perforating units which are so dimensioned and so arranged that they are situated in the gussets;

the frame outside the tubular foil being provided with means for exerting through the web material, a force to activate the perforating units;

each perforating unit comprising a fixed arm adapted to be introduced into one half of the gusset, and a pivotable arm adapted to be introduced into the other half of the gusset, the pivotable arm supporting a punch and the fixed arm supporting, at the corresponding place, a rubber cushion.

9. A device according to claim 8 wherein the means for exerting a pressure in order to activate the punching unit, comprise a pressure cylinder which is movable laterally together with the external disc.

10. A device for making perforations in the inner gusset portions of a tubular web of foil, comprising:

a frame having rollers;

a carrier supported on said rolls and adapted to be inserted into said tubular web;

a plurality of inner and outer discs, said outer discs arranged on the frame outside the tubular web, each outer disc being arranged between and cooperating with a respective pair of inner discs mounted on the carrier and located inside the tubular web so as to hold the form of the inwardly folded gussets on each side of the web; and means for perforating the inner gusset portions being mounted on said carrier for insertion inside of the web.

* * * * *